US011242583B2

(12) United States Patent
Nagano et al.

(10) Patent No.: US 11,242,583 B2
(45) Date of Patent: Feb. 8, 2022

(54) STEEL SHEET

(71) Applicant: NIPPON STEEL CORPORATION, Tokyo (JP)

(72) Inventors: Mai Nagano, Tokyo (JP); Koutarou Hayashi, Tokyo (JP); Akihiro Uenishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/761,724

(22) PCT Filed: Nov. 8, 2018

(86) PCT No.: PCT/JP2018/041522
§ 371 (c)(1),
(2) Date: May 5, 2020

(87) PCT Pub. No.: WO2019/093429
PCT Pub. Date: May 16, 2019

(65) Prior Publication Data

US 2020/0332397 A1 Oct. 22, 2020

(30) Foreign Application Priority Data

Nov. 8, 2017 (JP) ..... JP2017-215829

(51) Int. Cl.

| | |
|---|---|
| ***C22C 38/04*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |

(Continued)

(52) U.S. Cl.

CPC ..... *C22C 38/04* (2013.01); *C21D 1/185* (2013.01); *C21D 1/22* (2013.01); *C21D 8/021* (2013.01); *C21D 8/0205* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/38* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/008* (2013.01); *Y10T 428/12951* (2015.01); *Y10T 428/12972* (2015.01)

(58) Field of Classification Search

CPC ..... C22C 38/04; C22C 38/44; C22C 38/00; C22C 38/42; C22C 38/001; C22C 38/002; C22C 38/005; C22C 38/02; C22C 38/06; C22C 38/08; C22C 38/12; C22C 38/14; C22C 38/16; C22C 38/32; C22C 38/18; C22C 38/20; C22C 38/22; C22C 38/24; C22C 38/26; C22C 38/28; C22C 38/34; C22C 38/38; C22C 38/40; C22C 38/46; C22C 38/48; C22C 38/50; C22C 38/54; C22C 38/58; Y10T 428/12972; Y10T 428/12951; C21D 9/46; C21D 2211/001; C21D 2211/008; C21D 2211/002; C21D 1/22; C21D 1/185; C21D 8/0205; C21D 8/021

See application file for complete search history.

(56) References Cited

U.S. PATENT DOCUMENTS

2009/0242085 A1* 10/2009 Ikeda ..... C21D 1/20 148/624
2012/0180909 A1 7/2012 Ono et al.

(Continued)

FOREIGN PATENT DOCUMENTS

CN 102471852 A 5/2012
CN 104011234 A 8/2014

(Continued)

OTHER PUBLICATIONS

"Metallic materials—Tensile testing-Method of test at room temperature", JIS Z 2241 (2011), total of 169 pages.

(Continued)

*Primary Examiner* — Michael E. La Villa
(74) *Attorney, Agent, or Firm* — Birch, Stewart, Kolasch & Birch, LLP

(57) ABSTRACT

A steel sheet includes, as a chemical composition, by mass %: C: 0.05-0.30%; Si: 0.2-2.0%; Mn: 2.0-4.0%; Al: 0.001-2.000%; P: 0.100% or less; S: 0.010% or less; N: 0.010% or less; Ti: 0-0.100%; Nb: 0-0.100%; V: 0-0.100%; Cu: 0-1.00%; Ni: 0-1.00%; Mo: 0-1.00%; Cr: 0-1.00%; W: 0-0.005%; Ca: 0-0.005%; Mg: 0-0.005%; a rare earth element (REM): 0-0.010%; B: 0-0.0030%; and a remainder of Fe and impurities, in which a metallographic structure contains, by area ratio, 95% or more of a hard structure and 0-5% of residual austenite, by mass % in a cross section in a thickness direction, C1/C2 which is a ratio of an upper limit C1 of a Mn content to a lower limit C2 of the Mn content is 1.5 or less, and a bake-hardening amount BH is 150 MPa or less.

16 Claims, No Drawings

(51) Int. Cl.

| | |
|---|---|
| ***C22C 38/12*** | (2006.01) |
| ***C22C 38/14*** | (2006.01) |
| ***C22C 38/16*** | (2006.01) |
| ***C22C 38/32*** | (2006.01) |
| ***C21D 9/46*** | (2006.01) |
| ***C22C 38/58*** | (2006.01) |
| ***C22C 38/42*** | (2006.01) |
| ***C22C 38/44*** | (2006.01) |
| ***C22C 38/28*** | (2006.01) |
| ***C22C 38/26*** | (2006.01) |
| ***C22C 38/22*** | (2006.01) |
| ***C22C 38/50*** | (2006.01) |
| ***C22C 38/46*** | (2006.01) |
| ***C22C 38/54*** | (2006.01) |
| ***C22C 38/38*** | (2006.01) |
| ***C22C 38/18*** | (2006.01) |
| ***C22C 38/24*** | (2006.01) |
| ***C22C 38/34*** | (2006.01) |
| ***C22C 38/20*** | (2006.01) |
| ***C22C 38/48*** | (2006.01) |
| ***C22C 38/40*** | (2006.01) |
| ***C21D 1/22*** | (2006.01) |
| ***C21D 1/18*** | (2006.01) |
| ***C21D 8/02*** | (2006.01) |

(56) References Cited

U.S. PATENT DOCUMENTS

| | | | |
|---|---|---|---|
| 2013/0167980 | A1 | 7/2013 | Kawata et al. |
| 2015/0030879 | A1 | 1/2015 | Kosaka et al. |
| 2015/0329950 | A1 | 11/2015 | Azuma et al. |
| 2018/0023172 | A1 | 1/2018 | Ishida et al. |
| 2018/0127848 | A1 | 5/2018 | Hikida et al. |

FOREIGN PATENT DOCUMENTS

| | | | |
|---|---|---|---|
| JP | 2000-80440 | A | 3/2000 |
| JP | 2008-144233 | A | 6/2008 |
| JP | 2010-65307 | A | 3/2010 |
| JP | 2017-88944 | A | 5/2017 |
| JP | 2018-90874 | A | 6/2018 |
| TW | 201702405 | A | 1/2017 |
| TW | 201708558 | A | 3/2017 |
| WO | WO 2014/132968 | A1 | 9/2014 |

OTHER PUBLICATIONS

International Search Report for PCT/JP2018/041522 (PCT/ISA/210) dated Feb. 12, 2019.

Office Action issued in TW Application No. 107139701 dated Mar. 13, 2019.

Written Opinion of the International Searching Authority for PCT/JP2018/041522 (PCT/ISA/237) dated Feb. 12, 2019.

* cited by examiner

STEEL SHEET

TECHNICAL FIELD OF THE INVENTION

The present invention relates to a steel sheet.

This application claims priority based on Japanese Patent Application No. 2017-215829 filed in Japan on Nov. 8, 2017, the content of which is incorporated herein by reference.

RELATED ART

In recent years, for global environmental protection, there has been a demand for an improvement in fuel efficiency of vehicles. With regard to improving the fuel efficiency of vehicles, steel sheets for a vehicle are required to have further high-strengthening in order to reduce the weight of the vehicle body while ensuring safety. As such a high strength steel sheet, a composite structure steel sheet having a composite structure represented by dual-phase steel (DP steel) having a structure in which a hard structure such as martensite or bainite and soft ferrite are combined has been widely used.

Since such DP steel is generally a high alloy, alloying elements such as Mn are segregated in a direction parallel to a sheet thickness direction in a melting step. Since this segregation portion is stretched by hot rolling or cold rolling, the segregation portion is continuous in a band shape in a layered manner (hereinafter, this referred to as microsegregation). In case of DP steel, a hard phase is generated in this microsegregation portion. As a result, the hard phase becomes a structure that is continuous in a band shape. It is known that such a structure in which a hard phase generated due to microsegregation is continuous in a band shape significantly deteriorates hole expansibility and bendability.

As a technique for solving the problems caused by the above-mentioned microsegregation in DP steel, for example, Patent Document 1 describes a steel sheet in which Mn is diffused by being held in a temperature range of 1200° C. or higher and 1300° C. or lower for 0.5 h or longer and 5 h or shorter before a hot rolling step, whereby a ratio C1/C2 between an upper limit C1 and a lower limit C2 of the Mn concentration in a cross section of the steel sheet in a sheet thickness direction is 2.0 or less. In this steel sheet, it is disclosed that variation in stretch flangeability is significantly reduced by setting C1/C2 to 2.0 or less.

On the other hand, high-strengthening of the steel sheet causes a reduction in ductility, and a difficulty in cold press forming. Therefore, there is a demand for a material that is relatively soft and easy to form during forming, and has a large bake-hardening amount during coating baking after the forming. That is, for further high-strengthening of vehicle components, a steel sheet having high bake-hardenability is required. Bake-hardening is a strain aging phenomenon that occurs when interstitial elements (carbon and nitrogen) are locked to dislocations that are introduced by press forming (hereinafter, also referred to as "pre-strain"), during coating baking at a high temperature (150° C. to 200° C.).

However, the DP steel sheet containing a large amount of ferrite as described in Patent Document 1 has a problem that the bake-hardenability is generally low.

As a technique for improving the bake-hardenability, for example, Patent Document 2 describes a cold-rolled steel sheet in which a high bake-hardening amount is secured by including a hard structure consisting of bainite and martensite as the primary structure, and limiting the ferrite fraction to 5% or less.

However, as a result of examinations by the present inventors, it was found that in the cold-rolled steel sheet described in Patent Document 2, while a certain bake-hardenability can be obtained if the pre-strain is 1%, sufficient bake-hardenability cannot be obtained in a case where the pre-strain is small (for example, 0.5%). That is, in the cold-rolled steel sheet of Patent Document 2, it is necessary to increase the pre-strain in order to obtain high bake-hardenability.

PRIOR ART DOCUMENT

Patent Document

[Patent Document 1] Japanese Unexamined Patent Application, First Publication No. 2010-065307

[Patent Document 2] Japanese Unexamined Patent Application, First Publication No. 2008-144233

DISCLOSURE OF THE INVENTION

Problems to be Solved by the Invention

As described above, in steel sheets for a vehicle, excellent bake-hardenability has to be secured in order to meet the demand for further high-strengthening in the future. On the other hand, in a case where it is necessary to increase the pre-strain in order to obtain high bake-hardenability, this cannot be applied to a member having low workability at the time of press forming or the like. Moreover, an increase in pre-strain causes a decrease in ductility, so that application to a member that require excellent ductility is also difficult.

The present invention has been made in view of the above problems. An object of the present invention is to provide a steel sheet excellent in bake-hardenability capable of obtaining a sufficient bake-hardening amount even with a pre-strain of 0.5%.

Means for Solving the Problem

The present inventors have intensively studied to solve the above problems. As a result, it was clarified that among two types of segregation, center-line segregation and microsegregation, it is important to reduce microsegregation of alloying elements, and to form a structure containing 95% or more of a hard structure in which a dislocation density is increased in order to improve bake-hardenability.

In the related art, in a structure containing 95% or more of a hard structure, no hard phase is generated in a band shape, and therefore microsegregation is hardly considered. However, the present inventors found that dislocations introduced by pre-strain are uniformized by reducing microsegregation in a structure containing 95% or more of a hard structure and furthermore, bake-hardenability is improved by increasing a dislocation density during manufacturing.

A steel sheet of the present invention that can achieve the above object is as follows.

(1) A steel sheet according to an aspect of the present invention includes, as a chemical composition, by mass %: C: 0.05% to 0.30%; Si: 0.2% to 2.0%; Mn: 2.0% to 4.0%; Al: 0.001% to 2.000%; P: 0.100% or less; S: 0.010% or less; N: 0.010% or less; Ti: 0% to 0.100%; Nb: 0% to 0.100%; V: 0% to 0.100%; Cu: 0% to 1.00%; Ni: 0% to 1.00%; Mo: 0% to 1.00%; Cr: 0% to 1.00%; W: 0% to 0.005%; Ca: 0% to 0.005%; Mg: 0% to 0.005%; a rare earth element (REM): 0% to 0.010%; B: 0% to 0.0030%; and a consisting of Fe and impurities, in which a metallographic structure contains, by area ratio, 95% or more of a hard structure and 0% to 5% of residual austenite, by mass % in a cross section in a thickness direction, C1/C2 which is a ratio of an upper limit C1 of a Mn content to a lower limit C2 of the Mn content is 1.5 or less, and a bake-hardening amount BH is 150 MPa or more.

(2) In the steel sheet according to (1), the chemical composition may include, by mass %, one or two or more of: Ti: 0.003% to 0.100%; Nb: 0.003% to 0.100%; and V: 0.003% to 0.100%, and a total amount of Ti, Nb, and V is 0.100% or less.

(3) In the steel sheet according to (1) or (2), the chemical composition may include, by mass %, one or two or more of: Cu: 0.005% to 1.00%; Ni: 0.005% to 1.00%; Mo: 0.005% to 1.00%; and Cr: 0.005% to 1.00%, and a total amount of Cu, Ni, Mo, and Cr is 1.00% or less.

(4) In the steel sheet according to any one of (1) to (3), the chemical composition may include, by mass %, one or two or more of: W: 0.0003% to 0.005%; Ca: 0.0003% to 0.005%; Mg: 0.0003% to 0.005%; and a rare earth element (REM): 0.0003% to 0.010%, and a total amount of W, Ca, Mg, and the rare earth element (REM) is 0.010% or less.

(5) In the steel sheet according to any one of (1) to (4), the chemical composition may include, by mass %: B: 0.0001% to 0.0030%.

Effects of the Invention

According to the above aspect of the present invention, a steel sheet excellent in bake-hardenability can be provided by controlling the microsegregation of alloying elements in the steel sheet and increasing the dislocation density in the hard structure. This steel sheet is excellent in press formability, and further high-strengthened by being baked during coating after press forming, so that the steel sheet is suitable as a structural member of a vehicle and the like. In the present invention, excellent bake-hardenability means that the bake-hardening amount (BH amount) when a heat treatment is performed at 170° C. for 20 minutes after adding 0.5% pre-strain is 150 MPa or more.

EMBODIMENTS OF THE INVENTION

Bake-hardening is a strain aging phenomenon that occurs when interstitial elements (carbon and nitrogen) are locked to dislocations that have been pre-introduced into steel by pre-strain during heating to a high temperature (150° C. to 200° C.). In case of a steel sheet for a vehicle, bake-hardening occurs when interstitial elements (carbon and nitrogen) are locked to dislocations introduced by a press or the like during forming into a component, when coating baking is performed.

A bake-hardening amount is controlled by a dislocation density and the amount of dissolved carbon, and appears more prominently when both the parameters are increased. Moreover, a hard structure has a larger amount of dissolved carbon than ferrite and thus has high bake-hardenability. The present inventors intensively examined with the aim of further improving the bake-hardening amount in a high strength steel sheet having a hard structure as a primary phase. As a result, it was found that a high strength steel sheet having a hard structure as a primary phase has relatively high Si and Mn contents, and these alloying elements tend to segregate, so that dislocations introduced by pre-strain are not present uniformly. It was also found that hardness differences are likely to occur in the hard structure due to the segregation of the alloying elements, and the bake-hardening amount is not improved due to the influence of the hardness differences.

As a result of further examinations by the inventors, it was clarified that the hardness differences and the non-uniformity of the pre-strain are caused by microsegregation formed by segregation portions occurred during solidification being stretched by hot rolling or cold rolling. In addition, the present inventors found that the dislocations introduced by the pre-strain are uniformized by reducing the microsegregation of the alloying elements, and furthermore, the bake-hardenability of the steel sheet having a hard structure as a primary phase is improved by increasing the dislocation density during manufacturing.

It was also found that optimization of hot rolling conditions is effective for reducing the above-mentioned microsegregation, and temper rolling is effective after an annealing step for increasing the dislocation density.

During casting, substitutional elements such as Si and Mn are segregated parallel to a rolling direction at a thickness middle portion. This is generally called center-line segregation. Such center-line segregation may cause cracks at the thickness middle portion of a slab, or uneven distribution of alloying elements, and thereby it becomes difficult to control the structure in the subsequent annealing step and making the material unstable. As a result of examinations by the present inventors, even if the center-line segregation is reduced, the bake-hardenability is not improved unless the microsegregation is reduced. On the other hand, it was found that even if there is center-line segregation, the bake-hardenability is improved if the microsegregation can be controlled.

Hereinafter, a steel sheet according to the present embodiment will be described.

The steel sheet according to the embodiment of the present invention (steel sheet according to the present embodiment) is a steel sheet having a tensile strength TS of preferably 900 MPa or more and excellent bake-hardenability. The steel sheet including, as a chemical composition, by mass %: C: 0.05% to 0.30%; Si: 0.2% to 2.0%; Mn: 2.0% to 4.0%; P: 0.100% or less; S: 0.010% or less; Al: 0.001% to 2.000%; and N: 0.010% or less, optionally further including Ti, Nb, V, Cu, Ni, Mo, Cr, W, Ca, Mg, REM, and B, and including a remainder of Fe and impurities, in which a metallographic structure contains, by area ratio, 95% or more of a hard structure and 0% to 5% of residual austenite, in a cross section of the steel sheet in a thickness direction, C1/C2 which is a ratio of an upper limit C1 (unit: mass %) to a lower limit C2 (unit: mass %) of a Mn content is 1.5 or less, and a bake-hardening amount BH is 150 MPa or more.

Hereinafter, the chemical composition and structures will be described.

(I): Chemical Composition

The steel sheet according to the present embodiment is characterized in that the microstructural morphology is controlled by a manufacturing method. However, it is preferable that in order to obtain a steel sheet with further enhanced bake-hardenability while having excellent workability, the chemical composition is appropriately adjusted. Therefore, the chemical composition of the steel sheet according to the present embodiment and a slab used for manufacturing the steel sheet will be described. In the following description, "%", which is the unit of the amount of each element contained in the steel sheet and slab, means "mass %" unless otherwise specified.

(C: 0.05% to 0.30%)

C is an element that enhances the hardenability of the steel sheet. In addition, C is an element having an action of increasing strength by being contained in a hard structure such as a martensite structure. Moreover, C is also an element having an action of increasing bake-hardenability. In order to effectively exhibit the above actions, the C content is set to 0.05% or more. Preferably, the C content is set to 0.07% or more.

On the other hand, when the C content exceeds 0.30%, the weldability deteriorates. Therefore, the C content is set to 0.30% or less, and preferably 0.20% or less.

(Si: 0.2% to 2.0%)

Si is an element necessary for suppressing the generation of carbides and securing dissolved C necessary for bake-hardening. When the Si content is less than 0.2%, a sufficient effect may not be obtained. Furthermore, Si is an essential element for increasing the amount of dissolved C and achieving high-strengthening of the steel sheet having excellent bake-hardenability. In order to effectively exhibit this action, the Si content is set to 0.2% or more. More preferably, the Si content is set to 0.5% or more.

On the other hand, when the Si content exceeds 2.0%, the surface properties are deteriorated, the effect of including Si is saturated, and the cost is increased. Therefore, the Si content is set to 2.0% or less, and preferably 1.5% or less.

(Mn: 2.0% to 4.0%)

Mn is an element that contributes to improving the hardenability, and is an element useful for high-strengthening of the steel sheet. In order to effectively exhibit such an action, the Mn content is set to 2.0% or more. Preferably, the Mn content is set to 2.3% or more.

On the other hand, an excessive Mn content causes a decrease in low temperature toughness due to precipitation of MnS. Therefore, the Mn content is set to 4.0% or less.

(P: 0.100% or Less)

P is not an essential element, but is an element contained as an impurity in steel, for example. From the viewpoint of weldability, the lower the P content, the better. In particular, when the P content exceeds 0.100%, the weldability is significantly reduced. Therefore, the P content is set to 0.100% or less, and preferably 0.030% or less.

On the other hand, the lower the P content, the better, so that the P content may be 0%. However, the reduction of the P content is costly, and when it is attempted to reduce the P content to less than 0.0001%, the cost increases significantly. For this reason, the P content may be set to 0.0001% or more. Moreover, since P contributes to the improvement in strength, the P content may be set to 0.0001% or more.

(S: 0.010% or Less)

S is not an essential element, but is an element contained as an impurity in steel, for example. From the viewpoint of weldability, the lower the S content, the better. The higher the S content, the greater the amount of MnS precipitated and the lower the low temperature toughness. In particular, when the S content exceeds 0.010%, the weldability and the low temperature toughness are significantly reduced. Therefore, the S content is set to 0.010% or less, and preferably 0.005% or less.

On the other hand, the lower the S content, the better, so that the S content may be 0%. However, the reduction of the S content is costly, and when it is attempted to reduce the S content to less than 0.0001%, the cost increases significantly. For this reason, the S content may be set to 0.0001% or more.

(Al: 0.001% to 2.000%)

Al is an element having an effect on deoxidation and improvement in yield of carbide forming elements. In order to effectively exhibit the above action, the Al content is set to 0.001% or more. Preferably, the Al content is set to 0.010% or more.

On the other hand, when the Al content exceeds 2.000%, the weldability decreases, or the amount of oxide-based inclusions increase, so that the surface properties deteriorate. Therefore, the Al content is set to 2.000% or less. Preferably, the Al content is set to 1.000% or less.

(N: 0.010% or Less)

N is not an essential element but is contained as an impurity in steel, for example. From the viewpoint of weldability, the lower the N content, the better. In particular, when the N content exceeds 0.010%, the weldability is significantly reduced. Therefore, the N content is set to 0.010% or less, and preferably 0.006% or less.

On the other hand, since the lower the N content, the better, the N content may be 0%. However, the reduction of the N content is costly, and when it is attempted to reduce the N content to less than 0.0001%, the cost increases significantly. For this reason, the N content may be set to 0.0001% or more.

The composition of the base elements of the steel sheet according to the present embodiment is as described above, and the remainder is Fe and impurities incorporated from raw materials, materials, manufacturing equipment, and the like. Furthermore, the steel sheet according to the present embodiment may contain the following optional elements as necessary. Since the following optional elements do not necessarily have to be contained, the lower limit thereof is 0%.

(Ti: 0.100% or Less, Nb: 0.100% or Less, and V: 0.100% or Less)

Ti, Nb, and V are elements that contribute to the improvement of strength. Therefore, any one of Ti, Nb, and V or any combination thereof may be contained. In order to sufficiently obtain this effect, the amount of Ti, Nb, or V, or the total amount of any combination of two or more thereof is preferably 0.003% or more.

On the other hand, when the amount of Ti, Nb, or V, or the total amount of any combination of two or more thereof exceeds 0.100%, hot rolling and cold rolling become difficult. Therefore, the Ti content, Nb content, or V content, or the total amount of any combination of two or more thereof is set to 0.100% or less. That is, it is preferable that the limiting ranges in the case of each element alone are Ti: 0.003% to 0.100%, Nb: 0.003% to 0.100%, and V: 0.003% to 0.100%, and the total amount in the case of any combination thereof is 0.003% to 0.100%.

(Cu: 1.00% or Less, Ni: 1.00% or Less, Mo: 1.00% or Less, and Cr: 1.00% or Less)

Cu, Ni, Mo, and Cr are elements that contribute to the improvement of strength. Therefore, Cu, Ni, Mo, or Cr, or any combination thereof may be contained. In order to sufficiently obtain this effect, the amount of Cu, Ni, Mo, and Cr is preferably in a range of 0.005% to 1.00% in the case of each element alone, and the total amount of any combination of two or more thereof preferably satisfies 0.005% to 1.00%.

On the other hand, when the amount of Cu, Ni, Mo, and Cr, or the total amount in the case of any combination of two or more thereof exceeds 1.00%, the effect of the above action is saturated, and the cost increases unnecessarily. Therefore, the upper limit of the amount of Cu, Ni, Mo, and Cr, or the total amount in the case of any combination of two or more thereof is set to 1.00%. That is, it is preferable that Cu: 0.005% to 1.00%, Ni: 0.005% to 1.00%, Mo: 0.005% to 1.00%, and Cr: 0.005% to 1.00% are contained, and the total amount in the case of any combination thereof is 0.005% to 1.00%.

(W: 0.005% or Less, Ca: 0.005% or Less, Mg: 0.005% or Less, and REM: 0.010% or Less)

W, Ca, Mg, and REM are elements that contribute to fine dispersion of inclusions and increase toughness. Therefore, one of W, Ca, Mg, and REM or two or more thereof in any combination may be contained. In order to sufficiently obtain the above effect, the total amount of one of W, Ca, Mg, and REM or any combination of two or more thereof is preferably set to 0.0003% or more.

On the other hand, when the total amount of W, Ca, Mg, and REM exceeds 0.010%, the surface properties deteriorate. Therefore, the total amount of W, Ca, Mg and REM is set to 0.010% or less. That is, it is preferable that W: 0.0003% to 0.005%, Ca: 0.0003 to 0.005%, Mg: 0.0003% to 0.005%, and REM: 0.0003% to 0.010% are contained, and the total amount of two or more thereof is 0.0003% to 0.010%.

REM (rare earth element) refers to a total of 17 elements of Sc, Y, and lanthanoids, and "REM content" means the total amount of these 17 elements. Lanthanoids are added industrially, for example, in the form of mischmetal.

(B: 0.0030% or Less)

B is an element that improves the hardenability and is an element useful for high-strengthening of a steel sheet for bake-hardening. B may be contained in an amount of 0.0001% (1 ppm) or more.

On the other hand, even when the B content exceeds 0.0030% (30 ppm), the above effect is saturated and the cost increases. Therefore, the B content is set to 0.0030% or less. Preferably, the B content is set to 0.0025% or less.

(II): Structure of Steel

The steel sheet according to the present embodiment is intended for a structure including a hard structure and residual austenite. The steel sheet according to the present embodiment has a great feature in that bake-hardenability is improved by controlling the microsegregation of Mn and increasing the dislocation density. The reason why the area ratio is specified for each structure will be described.

(Hard Structure: 95% or More)

The steel sheet according to the present embodiment has a great feature in that a hard structure is secured in an area ratio of 95% or more in the metallographic structure. Here, the hard structure indicates bainite and martensite. That is, in the steel sheet according to the present embodiment, the total area ratio of bainite and martensite is 95% or more. Thereby, the dislocation density when a steel sheet is manufactured can be increased, and as a result, bake-hardenability can be improved. In order to further enhance such an effect, it is recommended that 97% or more of the hard structure is secured. The area ratio of the hard structure is more preferably 99% or more, and may be 100%.

(Residual Austenite)

There are cases where a trace amount of residual austenite is formed depending on the chemical compositions of steel and the manufacturing method. When such residual austenite is 5% or less in terms of area ratio, the residual austenite does not affect bake-hardenability, and moreover, contributes to the improvement of ductility due to a TRIP effect under deformation. Therefore, the steel sheet according to the present embodiment may contain residual austenite in an area ratio range of 5% or less.

However, in order to further enhance the bake-hardenability, the area ratio of the residual austenite is preferably set to 3% or less, more preferably 1% or less, and even more preferably 0%.

There are cases where ferrite and pearlite are generated as the residual structure other than the hard structure and residual austenite. The total area ratio thereof is preferably set to 1% or less, and more preferably 0%.

In the present embodiment, the area ratio of the hard structure is determined as follows. First, a sample is collected with a sheet thickness cross section perpendicular to the rolling direction of the steel sheet as an observed section, the observed section is polished and subjected to nital etching, and the structure at a ¼ position of the thickness of the steel sheet is observed with a scanning electron microscope (SEM) at a magnification of 5,000-fold. Image analysis is performed on a visual field of 100 μm×100 μm to measure the area ratios of ferrite and pearlite. Five visual fields are measured at the center in a sheet width direction, and the average of these measurement values is obtained. The ferrite here refers to, for example, polygonal ferrite, pseudopolygonal ferrite, or Widmanstatten ferrite, and can be determined as bainite or martensite when carbide is present in the lath or at the lath boundary.

Thereafter, the area ratio of the residual austenite is obtained. The area ratio of the residual austenite can be specified by, for example, X-ray diffraction measurement. In this method, for example, a portion from the surface of the steel sheet to ¼ of the thickness of the steel sheet is removed by mechanical polishing and chemical polishing, and MoKα rays are used as characteristic X-rays. From the integrated intensity ratio of the diffraction peaks of (200) and (211) of a body-centered cubic lattice (bcc) phase and (200), (220), and (311) of a face-centered cubic lattice (fcc) phase, the volume percentage of the residual austenite is calculated using the following formula. Then, assuming that the volume percentage is equal to the area ratio, the volume percentage is regarded as the area ratio.

A value obtained by subtracting the area ratio of ferrite and pearlite obtained by the above method and the area ratio of the residual austenite from the whole (100%) is taken as the area ratio of the hard structure.

$$S\gamma=(I_{200f}+I_{220f}+I_{311f})/(I_{200b}+I_{211b})\times 100$$

In the above formula, Sγ represents the area ratio of residual austenite, $I_{200f}$, $I_{220f}$, and $I_{311f}$ respectively represent the diffraction peak intensities of (200), (220), and (311) of the fcc phase, and $I_{200b}$ and $I_{211b}$ respectively represent the diffraction peak intensities of (200) and (211) of the bcc phase.

(C1/C2 is 1.5 or Less)

The ratio C1/C2 of the upper limit C1 (unit: mass %) and the lower limit C2 (unit: mass %) of the Mn concentration in the cross section in the thickness direction of the steel sheet is 1.5 or less. More preferably, C1/C2 is 1.3 or less. In a case where C1/C2 is 1.5 or less, the microsegregation of the alloying elements is suppressed. Particularly, the microsegregation of Mn is suppressed, and the structure becomes uniform. As a result, the bake-hardening amount BH and the tensile strength can be increased.

Furthermore, in a case where the hard structure is the primary phase and the ferrite fraction is 5% or less, a structure in which the hard structure is continuous in a band shape is not generated. In such a case, it is considered that necessary hole expansibility and bendability are secured even though microsegregation is not eliminated. In addition, when microsegregation is eliminated in the hard structure, there is a concern that a yield ratio may increase and a load required for forming may increase. Therefore, hitherto, eliminating microsegregation in a steel sheet primarily containing a hard structure has not been considered. However, even in such a case, there are cases where sufficient local ductility is not obtained. In the steel sheet according to the present embodiment, local ductility is improved by causing the microsegregation represented by C1/C2 to be 1.5 or less.

The degree of microsegregation of Mn represented by C1/C2 is measured as follows.

The steel sheet is adjusted so that a cross section in the sheet thickness direction in which the rolling direction is the normal direction can be observed and then mirror-polished, and in the cross section of the steel sheet in the sheet thickness direction, in a range of 100 μm in the sheet thickness direction included in a region between a ⅜ position and a ¼ position of the thickness of the steel sheet from the surface of the steel sheet, the Mn content is measured at 200 points with an interval of 0.5 μm from one surface side to the other surface side along the steel sheet thickness direction, by an electron probe microanalyzer (EPMA) apparatus. Here, the Mn content is measured, while avoiding inclusions such as MnS. The same measurement is performed on five lines covering almost the entire region in the width direction in the cross section of the steel sheet, and by employing the highest value among the Mn contents measured on all the five lines as the upper limit C1 (unit: mass %) of the Mn content and the lowest value as the lower limit C2 (mass %) of the Mn content, the ratio C1/C2 is calculated. The measurement is performed on the region between the ⅜ position and the ¼ position of the thickness of the steel sheet from the surface of the steel sheet because this range shows a representative structure of the steel sheet and is not affected by center-line segregation.

(Tensile Strength TS: 900 MPa or More)

The steel sheet according to the present embodiment preferably has a tensile strength of 900 MPa. The reason why the tensile strength is set to 900 MPa or more is to satisfy the demand for a reduction in the weight of a vehicle body. The tensile strength TS is more preferably 1000 MPa or more, and even more preferably 1100 MPa or more.

(Bake-Hardening Amount BH: 150 MPa or More)

In the steel sheet according to the present embodiment, the bake-hardening amount BH after 0.5% pre-strain is added and a heat treatment at 170° C. for 20 minutes is performed is set to 150 MPa or more.

When the bake-hardening amount BH is less than 150 MPa, it is difficult to perform forming and the strength after the forming is low. Therefore, it cannot be said that the bake-hardenability is excellent. Therefore, BH is set to 150 MPa or more. BH is more preferably 200 MPa or more, and most preferably 250 MPa or more.

When the pre-strain is increased, the bake-hardening amount is increased. However, when the pre-strain is increased in order to increase the bake-hardening amount, the ductility of the steel sheet after bake-hardening is reduced. In the steel sheet according to the present embodiment, the bake-hardening amount after adding 0.5% pre-strain, which is a relatively small pre-strain, is 150 MPa or more.

A method of measuring the bake-hardening amount BH is as follows.

First, a No. 5 test piece defined in JIS Z 2241:2011 having a direction perpendicular to a rolling direction as a longitudinal direction is prepared from a steel sheet. Next, a tensile load is applied to the test piece to add 0.5% pre-strain, and then a heat treatment at 170° C. for 20 minutes is preformed. Subsequently, the yield stress when the test piece after the heat treatment is re-tensioned is obtained, a value obtained by subtracting the stress at the time of adding 0.5% pre-strain from the yield stress is obtained, and this value is defined as a bake-hardening amount BH.

(III): Manufacturing Method

Next, a manufacturing method of the steel sheet according to the present embodiment will be described. The following description is intended to exemplify a characteristic method for manufacturing the steel sheet according to the present embodiment described above, and is not intended to limit the manufacturing of the steel sheet according to the present invention to the manufacturing method as described below.

In the manufacturing method of the steel sheet according to the present embodiment, (I) a homogenization process of performing multiaxial deformation processing of a slab having the above chemical composition, (II) a rolling step of performing hot rolling and cold rolling, and (III) an annealing step and a temper rolling step are performed in this order. In the rolling step, pickling may be performed before the cold rolling. In the manufacturing method of the steel sheet according to the present embodiment, the multiaxial deformation processing is performed instead of rough rolling normally performed in hot rolling. In the multiaxial deformation processing, compressive deformation processing is performed not only in the thickness direction of the slab but also in the width direction of the slab, so that it is possible to eliminate microsegregation of alloying elements (particularly Mn).

(Homogenization Process)

The slab to be subjected to the homogenization process can be manufactured by a continuous casting method after molten steel having the above chemical composition is melt using, for example, a converter or an electric furnace. Instead of the continuous casting method, an ingot-making method, a thin slab casting method, or the like may be employed.

The slab is heated to 1000° C. to 1300° C. before being subjected to the multiaxial deformation processing. When a slab heating temperature is low, a finish rolling temperature becomes lower than an $Ac_3$ transformation point, and multiaxial deformation processing and subsequent rolling may be performed in a dual phase region of ferrite and austenite, so that there are cases where the hot-rolled sheet structure becomes an inhomogeneous duplex grained structure. In this case, the inhomogeneous structure is not eliminated even after the cold rolling and annealing steps.

Even if the slab heating temperature exceeds 1300° C., the effect of eliminating segregation of the alloying elements is saturated. Therefore, the upper limit of the slab heating temperature may be set to 1300° C. or lower.

A heating retention time is not particularly limited, but it is preferable to retain the heating temperature for 30 minutes or longer in order to obtain a predetermined temperature up to the central part of the slab. The heating retention time is preferably ten hours or shorter and more preferably five hours or shorter in order to suppress excessive scale loss.

The multiaxial deformation processing is performed on the heated slab. In the multiaxial deformation processing, compressive deformation processing in the width direction and compressive deformation processing in the thickness direction are performed on the slab at 1000° C. to 1250° C. Here, the width direction of the slab is a direction corresponding to the sheet width direction of a steel sheet as a product, and the thickness direction of the slab is a direction corresponding to the sheet thickness direction of the steel sheet as a product. Due to the multiaxial deformation processing, a portion where the alloying elements such as Mn in the slab are concentrated is divided or lattice defects are introduced. For this reason, microsegregation of the alloying elements is suppressed during the multiaxial deformation processing, and a very homogeneous structure is obtained. In particular, compressive deformation processing in the width direction of the slab is effective. That is, by the multiaxial deformation processing, the concentrated portions of the alloying elements that are continuous in the width direction are finely divided, so that the alloying elements are uniformly dispersed. As a result, the homogenization of the structure that cannot be realized by simply diffusing the alloying element by simply heating for a long period of time, can be realized within a short period of time.

As the multiaxial deformation processing, for example, compressive deformation processing in the width direction and compressive deformation processing in the thickness direction are performed.

The multiaxial deformation processing is preferably performed in a temperature range of 1000° C. to 1250° C. When the slab temperature during the multiaxial deformation processing is lower than 1000° C., the multiaxial deformation processing is performed in the dual phase region of ferrite and austenite, and there are cases where ferrite precipitates in the metallographic structure of the steel sheet, which is not preferable. Moreover, even when the slab temperature during the multiaxial deformation processing exceeds 1250° C., the segregation effect of the alloying elements is saturated. Therefore, the upper limit of the slab temperature may be set to 1250° C. or lower. That is, the highest temperature during the multiaxial deformation processing is 1250° C. or lower, and the lowest temperature is 1000° C. or higher.

When the deformation ratio per one compressive deformation processing in the width direction is less than 3%, the amount of lattice defects introduced by plastic deformation is insufficient, and segregation of alloying elements cannot be suppressed. Therefore, the deformation ratio per one compressive deformation processing in the width direction is set to 3% or more, preferably 10% or more, and more preferably 30% or more.

On the other hand, when the deformation ratio per one compressive deformation processing in the width direction exceeds 50%, slab cracking occurs or the shape of the slab becomes non-uniform, and the dimensional accuracy of a hot-rolled steel sheet obtained by hot rolling decreases. Therefore, the deformation ratio per one compressive deformation processing in the width direction is set to 50% or less, and preferably 40% or less.

When the deformation ratio per one compressive deformation processing in the thickness direction is less than 3%, the amount of lattice defects introduced by plastic deformation is insufficient, and segregation of alloying elements cannot be suppressed. Furthermore, due to shape defects, there is a concern that biting of the slab into rolling rolls during hot rolling may fail. Therefore, the deformation ratio per one compressive deformation processing in the thickness direction is set to 3% or more, preferably 10% or more, and more preferably 30% or more.

On the other hand, when the deformation ratio per one compressive deformation processing in the thickness direction exceeds 50%, there is a case where slab cracking occurs or the slab shape becomes non-uniform, and the dimensional accuracy of a hot-rolled steel sheet obtained by hot rolling decreases. Therefore, the deformation ratio per one compressive deformation processing in the thickness direction is set to 50% or less, and preferably 40% or less.

In a case where the difference between the deformation ratio in the width direction and the deformation ratio in the thickness direction is excessively large, the alloying elements such as Mn do not diffuse sufficiently in a direction perpendicular to a direction in which the deformation ratio is small, and microsegregation may not be sufficiently reduced in the hard structure. In particular, in a case where the difference in deformation ratio exceeds 20%, it is difficult to eliminate microsegregation. Therefore, the difference in deformation ratio between the width direction and the thickness direction is preferably set to 20% or less.

When the multiaxial deformation processing is performed at least once (each in the width direction processing and the thickness direction processing once), segregation of the alloying elements can be suppressed. However, the effect of suppressing segregation of the alloying elements becomes significant by repeating the multiaxial deformation processing. Therefore, the number of times of multiaxial deformation processing is set to one or more, and preferably two or more. In a case of performing multiaxial deformation processing twice or more, the slab may be reheated to a temperature range of 1000° C. to 1250° C. during the multiaxial deformation processing.

On the other hand, when the number of times of multiaxial deformation processing is more than five, the manufacturing cost increases unnecessarily, the scale loss increases, and the yield decreases. In addition, there are cases where the thickness of the slab becomes non-uniform and it is difficult to perform hot rolling. Therefore, the number of times of multiaxial deformation processing is preferably set to five or less, and more preferably four or less.

The deformation ratio in the multiaxial deformation processing is defined as follows. For the slab, regarding the deformation ratio in a case of performing multiaxial deformation processing once with compressive deformation processing in the width direction and in the thickness direction, the deformation ratio is obtained from the following formula based on a width dimension $w_1$ and a thickness dimension $t_1$ of the slab before the multiaxial deformation processing, and a width dimension $w_2$ and a thickness dimension $t_2$ of the slab after the multiaxial deformation processing. Moreover, in a case of performing multiaxial deformation processing several times, the deformation ratio is obtained from the width dimensions and thickness dimensions before and after each multiaxial deformation processing.

$$\text{Deformation ratio in width direction (\%)}=(w_2-w_1)/w_1\times 100$$

$$\text{Deformation ratio in thickness direction (\%)}=(t_2-t_1)/t_1\times 100$$

(Rolling Step)

Hot rolling is performed as finish rolling on the slab after the multiaxial deformation processing is performed. In addition, cold rolling is performed after pickling the hot-rolled steel sheet is performed after the hot rolling as necessary. In the manufacturing method of the steel sheet according to the present embodiment, as the hot rolling, so-called rough rolling is not performed, but finish rolling is performed on the slab after the multiaxial deformation processing.

Regarding the hot rolling, the slab after the multiaxial deformation processing is used as a material, this slab is heated to 1000° C. or higher, hot rolling is performed on the heated slab by setting the total rolling reduction (cumulative rolling reduction) to 50% or less and the hot rolling finishing temperature (FT) to 800° C. or higher. Thereafter, the resultant is subjected to air cooling and coiled in a coiling temperature (CT) of 500° C. or higher and 700° C. or lower. By performing hot rolling under such conditions, Mn divided by the multiaxial deformation processing is further diffused, and it is possible to eliminate the microsegregation of Mn.

When the total rolling reduction exceeds 50%, austenite is stretched, Mn is concentrated, and microsegregation is not eliminated. Therefore, the total rolling reduction is set to 50% or less. When the hot rolling finishing temperature is 800° C. or lower, recrystallization is insufficient and unrecrystallized austenite remains, so that Mn is concentrated and microsegregation is not eliminated. Therefore, the hot rolling finishing temperature is set to 800° C. or higher, and preferably 850° C. or higher.

Furthermore, when the coiling temperature exceeds 700° C., pearlite is generated, Mn is concentrated, and microsegregation is not eliminated. Therefore, the coiling temperature is set to 700° C. or lower, and preferably 650° C. or lower. On the other hand, when the coiling temperature is lower than 500° C., the alloying elements do not diffuse during coiling, and the microsegregation of Mn is not eliminated. Therefore, the coiling temperature is set to 500° C. or higher, and preferably 550° C. or higher.

As cold rolling, from the viewpoint of homogenizing and refining the structure, the total rolling reduction of cold rolling is preferably set to 50% or more.

(Continuous Annealing Step)

The steel sheet (cold rolled steel sheet) obtained through the rolling step is subjected to an annealing. In the annealing, the steel sheet is heated in a temperature range of $Ac_3$ or higher and 1200° C. or lower and retained for 10 to 1000 seconds. The annealing temperature is the surface temperature of the steel sheet. This temperature range and annealing time are for austenite transformation of the entire steel sheet.

When the annealing time exceeds 1000 seconds, the productivity decreases. Therefore, the annealing time is set to 10 to 1000 seconds. When the annealing temperature is lower than $Ac_3$ or the annealing time is shorter than 10 seconds, ferrite is likely to precipitate. When the annealing temperature exceeds 1200° C., the austenite grain size becomes coarse, a hard structure having a large lath width is generated, and toughness is deteriorated.

The $Ac_3$ point is calculated by the following formula. An element symbol in the following formula is substituted with mass % of the corresponding element. 0 mass % is substituted into elements that are not contained.

$$Ac_3=937-477\times C+56\times Si-20\times Mn-16\times Cu-27\times Ni-5\times Cr+38\times Mo+125\times V+136\times Ti-19\times Nb+198\times Al+3315\times B$$

The steel sheet is heled at the annealing temperature (soaking temperature) for 10 to 1000 seconds, and then cooled at an average cooling rate of 10° C./s or more. In order to freeze the structure and efficiently cause martensitic transformation, a faster average cooling rate is better. When the average cooling rate is slower than 10° C./s, ferrite is generated, and the steel sheet cannot be controlled to a desired structure. Therefore, the average cooling rate is set to 10° C./s or faster. The average cooling rate is preferably 40° C./s or faster.

In order to sufficiently generate a hard structure, a cooling stop temperature is set to 400° C. or lower. Thereafter, the hard structure may be tempered to improve toughness. For the tempering, cooling is stopped at 400° C. or lower and slow cooling is performed by air cooling at 0.5° C./s or slower, or a heating retention step of retaining in a temperature range of 200° C. to 400° C. for 10 to 1000 seconds may be performed.

The average cooling rate is a value obtained by dividing the temperature drop width of the steel sheet from the start of cooling to the end of cooling by an elapsed time from the start of cooling to the end of cooling. For example, the start of cooling is when a steel sheet is introduced into a cooling facility, and the end of cooling is when the steel sheet is taken out from the cooling facility. The cooling end temperature is the surface temperature of the steel sheet immediately after being taken out from the cooling facility. The cooling is preferably cooling using water as a cooling medium.

(Skin Pass Rolling Step)

A final skin pass rolling is performed on the cooled steel sheet. Accordingly, a dislocation density can be increased and bake-hardenability can be increased. In order to uniformly introduce strain into the steel sheet, the rolling reduction is set to 0.1% or more. On the other hand, when the rolling reduction increases, it becomes difficult to control the sheet thickness. Therefore, the upper limit thereof is set to 0.5%. For the above reasons, the rolling reduction in the skin pass rolling step is set to 0.1% or more and 0.5% or less.

In this manner, the steel sheet according to the embodiment of the present invention can be manufactured.

The above-described embodiments are merely examples of implementation in carrying out the present invention, and the technical scope of the present invention is not construed as being limited thereto. That is, the present invention can be embodied in various forms without departing from the technical idea or the main features thereof.

EXAMPLES

Next, examples of the present invention will be described. The conditions in the examples are condition examples adopted to confirm the feasibility and effects of the present invention, and the present invention is not limited to the condition examples. The present invention can adopt various conditions as long as the object of the present invention is achieved without departing from the gist of the present invention.

A slab having the chemical composition shown in Table 1 was manufactured, and the slab was heated at a temperature of 1000° C. or higher and 1300° C. or lower for 1.0 to 1.5 hours, and then subjected to multiaxial deformation processing under the conditions shown in Table 2-1 (here, unidirectional compressive deformation was applied to Sample Nos. 24 and 26). Table 2-1 shows the temperature of the slab during the multiaxial deformation processing as the maximum temperature and the minimum temperature. Next, the slab was reheated to 1250° C. and hot-rolled under the conditions shown in Table 2-1 to obtain a hot-rolled steel sheet. In the hot rolling, hot rolling with the total rolling reduction shown in Table 2-1, coiling, and thereafter retaining at the coiling temperature for one hour were performed. In Table 2-1, FT is the hot rolling finish finishing temperature, and CT is the coiling temperature, which is the surface temperature of the steel sheet. Thereafter, the hot-rolled steel sheet was pickled and cold-rolled at the rolling reduction shown in Table 2-2 to obtain a cold-rolled steel sheet. Subsequently, continuous annealing was performed at the temperature and time shown in Table 2-2, and cooling to 400° C. or lower was performed at the average cooling rate shown in Table 2-2. Some were subjected to heating retention after the cooling was stopped. Subsequently, temper rolling was performed. The underline in Table 1 indicates that the numerical value is out of the desired range. Each temperature shown in Table 2-1 and Table 2-2 is the surface temperature of the steel sheet.

Acs in Table 2-2 was calculated by the following formula. An element symbol in the following formula was substituted with mass % of the corresponding element. 0 mass % was substituted into elements that were not contained.

$$Ac_3=937-477\times C+56\times Si-20\times Mn-16\times Cu-27\times Ni-5\times Cr+38\times Mo+125\times V+136\times Ti-19\times Nb+198\times Al+3315\times B$$

TABLE 1

| Kind of steel | Chemical composition (unit: mass %, remainder of Fe and impurities) | | | | | | | | | | |
|---|---|---|---|---|---|---|---|---|---|---|---|
| | C | Si | Mn | P | S | Al | N | Ti | Nb | V | Cu |
| A | 0.10 | 1.0 | 2.1 | 0.011 | 0.004 | 0.020 | 0.003 | | | | |
| B | 0.13 | 1.0 | 2.2 | 0.012 | 0.004 | 0.020 | 0.003 | 0.030 | | | |
| C | 0.16 | 1.0 | 6.0 | 0.010 | 0.004 | 0.020 | 0.003 | | | | |
| D | 0.10 | 1.0 | 3.0 | 0.011 | 0.004 | 0.020 | 0.003 | | | | |
| E | 0.20 | 1.2 | 2.2 | 0.012 | 0.004 | 0.020 | 0.003 | | | | 0.01 |
| F | 0.20 | 1.2 | 2.0 | 0.012 | 0.004 | 0.020 | 0.003 | | | 0.004 | |
| G | 0.03 | 1.0 | 2.4 | 0.011 | 0.004 | 0.020 | 0.003 | | | | |
| H | 0.15 | 0.003 | 2.4 | 0.010 | 0.003 | 0.020 | 0.003 | | | | |
| I | 0.14 | 0.5 | 2.5 | 0.010 | 0.003 | 0.020 | 0.003 | 0.005 | 0.005 | | |
| J | 0.17 | 1.8 | 2.6 | 0.009 | 0.004 | 0.020 | 0.003 | | | | |
| K | 0.16 | 1.8 | 0.05 | 0.010 | 0.003 | 0.020 | 0.003 | | | | |
| L | 0.13 | 1.0 | 2.2 | 0.012 | 0.003 | 0.020 | 0.003 | | | | |
| M | 0.14 | 1.1 | 2.2 | 0.012 | 0.004 | 0.020 | 0.003 | | | | |
| N | 0.25 | 1.0 | 2.4 | 0.011 | 0.004 | 0.020 | 0.003 | | | | |
| O | 0.13 | 1.0 | 2.2 | 0.012 | 0.004 | 0.020 | 0.003 | | | | |
| P | 0.13 | 1.0 | 2.3 | 0.011 | 0.004 | 0.020 | 0.003 | | | | |
| Q | 0.30 | 1.5 | 2.0 | 0.011 | 0.002 | 0.035 | 0.003 | | | | |
| R | 0.13 | 1.0 | 2.3 | 0.011 | 0.004 | 0.020 | 0.003 | | | | |
| S | 0.10 | 1.1 | 2.6 | 0.011 | 0.004 | 0.900 | 0.003 | | 0.01 | | |

| Kind of steel | Chemical composition (unit: mass %, remainder of Fe and impurities) | | | | | | | | |
|---|---|---|---|---|---|---|---|---|---|
| | Ni | Mo | Cr | W | Ca | Mg | REM | B | $Ac_3$ |
| A | | | | | | | | | 907 |
| B | | | | | | | | | 895 |
| C | | | | | | | | | 801 |
| D | | 0.005 | | | | | | | 889 |
| E | | | | | | | | | 869 |
| F | | | | | | | | | 873 |
| G | | | | | | | | | 935 |
| H | | | | | | | | | 822 |
| I | | | | | | | | | 853 |
| J | | | | | 0.002 | | | | 909 |
| K | | | | | | | | | 964 |
| L | | | 0.004 | | | | | | 891 |
| M | | | | 0.005 | | | | | 892 |
| N | | | | | | | | | 830 |
| O | | | | | | 0.002 | 0.002 | | 891 |
| P | | | | | | | | 0.0021 | 896 |
| Q | | | | | | | | | 845 |
| R | 0.01 | | | | | | | | 889 |
| S | | | 0.01 | | | | | | 1077 |

TABLE 2-1

| | | Multiaxial deformation processing | | | | | | | Hot rolling | | |
|---|---|---|---|---|---|---|---|---|---|---|---|
| Sample No. | Kind of steel | Heating temperature (° C.) | Heating time (hr) | Number of times of multiaxial deformation processing (times) | Highest temperature during multiaxial deformation processing (° C.) | Lowest temperature during multiaxial deformation processing (° C.) | Compressive deformation ratio in sheet width direction (%) | Compressive deformation ratio in sheet thickness direction (%) | Total rolling reduction (%) | FT (° C.) | CT (° C.) |
| 1 | A | 1250 | 1.0 | 3 | 1240 | 1050 | 35 | 30 | 40 | 901 | 650 |
| 2 | A | 1200 | 1.5 | 3 | 1190 | 1010 | 35 | 30 | 45 | 887 | 600 |
| 3 | B | 1250 | 1.0 | 3 | 1240 | 1050 | 35 | 30 | 45 | 887 | 600 |
| 4 | C | 1250 | 1.0 | 2 | 1240 | 1130 | 35 | 30 | 45 | 892 | 650 |
| 5 | D | 1300 | 1.0 | 4 | 1240 | 1020 | 35 | 30 | 45 | 890 | 650 |

TABLE 2-1-continued

| | | Multiaxial deformation processing | | | | | | | Hot rolling | | |
|---|---|---|---|---|---|---|---|---|---|---|---|
| Sample No. | Kind of steel | Heating temperature (° C.) | Heating time (hr) | Number of times of multiaxial deformation processing (times) | Highest temperature during multiaxial deformation processing (° C.) | Lowest temperature during multiaxial deformation processing (° C.) | Compressive deformation ratio in sheet width direction (%) | Compressive deformation ratio in sheet thickness direction (%) | Total rolling reduction (%) | FT (° C.) | CT (° C.) |
| 6 | E | 1250 | 1.0 | 5 | 1240 | 1010 | 35 | 30 | 45 | 902 | 650 |
| 7 | E | 1250 | 1.0 | 3 | 1240 | 1050 | 35 | 30 | 45 | 902 | 650 |
| 8 | E | 1250 | 1.0 | 3 | 1240 | 1050 | 35 | 30 | 45 | 901 | 650 |
| 9 | F | 1250 | 1.0 | 3 | 1240 | 1050 | 35 | 30 | 45 | 899 | 650 |
| 10 | F | 1250 | 1.0 | 3 | 1240 | 1050 | 35 | 30 | 45 | 887 | 650 |
| 11 | G | 1250 | 1.0 | 3 | 1240 | 1050 | 35 | 30 | 45 | 885 | 650 |
| 12 | H | 1000 | 1.0 | 3 | 1240 | 1050 | 35 | 30 | 45 | 885 | 650 |
| 13 | I | 1250 | 1.0 | 3 | 1240 | 1050 | 35 | 30 | 45 | 886 | 650 |
| 14 | I | 1250 | 1.0 | 3 | 960 | 740 | 35 | 30 | 45 | 886 | 650 |
| 15 | I | 1250 | 1.0 | 3 | 1230 | 1050 | 35 | 30 | 45 | 886 | 400 |
| 16 | J | 1250 | 1.0 | 3 | 1240 | 1050 | 35 | 30 | 45 | 890 | 650 |
| 17 | K | 1250 | 1.0 | 3 | 1240 | 1050 | 35 | 30 | 45 | 885 | 650 |
| 18 | L | 1250 | 1.0 | 3 | 1240 | 1050 | 35 | 30 | 45 | 886 | 650 |
| 19 | L | 1200 | 1.5 | 1 | 1240 | 1050 | 2 | 30 | 45 | 890 | 650 |
| 20 | M | 1200 | 1.5 | 3 | 1240 | 1050 | 35 | 30 | 45 | 890 | 650 |
| 21 | N | 1200 | 1.5 | 3 | 1240 | 1050 | 35 | 30 | 45 | 885 | 650 |
| 22 | O | 1250 | 1.0 | 3 | 1240 | 1050 | 35 | 30 | 45 | 886 | 650 |
| 23 | O | 1250 | 1.0 | 3 | 1240 | 1050 | 35 | 30 | 75 | 886 | 650 |
| 24 | O | 1250 | 1.0 | Absent | 1240 | 1050 | — | 40 | 45 | 886 | 650 |
| 25 | P | 1250 | 1.0 | 3 | 1240 | 1050 | 35 | 30 | 45 | 886 | 650 |
| 26 | Q | 1250 | 1.0 | Absent | 1240 | 1050 | — | 40 | 45 | 878 | 650 |
| 27 | Q | 1250 | 1.0 | 3 | 1240 | 1100 | 3 | 30 | 50 | 870 | 650 |
| 28 | R | 1250 | 1.0 | 3 | 1240 | 1050 | 35 | 30 | 45 | 886 | 650 |
| 29 | R | 1250 | 1.0 | 3 | 1240 | 1050 | 35 | 30 | 45 | 750 | 650 |
| 30 | R | 1250 | 1.0 | 3 | 1240 | 1050 | 35 | 30 | 45 | 886 | 750 |
| 31 | S | 1250 | 1.0 | 3 | 1240 | 1050 | 30 | 30 | 50 | 890 | 650 |

TABLE 2-2

| | Cold | Annealing | | | | | | | |
|---|---|---|---|---|---|---|---|---|---|
| Sample No. | rolling Cold rolling reduction (%) | Ac3 (° C.) | Annealing temperature (° C.) | Annealing time (sec) | Colling rate (° C./s) | Cooling stop temperature (° C.) | Low temperature retention temperature (° C.) | Low temperature retention time (sec) | Temper rolling Skin pass rolling (%) |
| 1 | 55 | 907 | 920 | 300 | 50 | 80 | — | — | 0.4 |
| 2 | 65 | 907 | 920 | 200 | 50 | 400 | 300 | 300 | Absent |
| 3 | 65 | 895 | 950 | 200 | 50 | 400 | 300 | 300 | 0.4 |
| 4 | 65 | 801 | 900 | 200 | 50 | 200 | — | — | 0.4 |
| 5 | 65 | 889 | 900 | 200 | 50 | 350 | 300 | 300 | 0.4 |
| 6 | 55 | 869 | 900 | 200 | 50 | 200 | — | — | 0.4 |
| 7 | 55 | 869 | 700 | 200 | 50 | 400 | 300 | 300 | 0.4 |
| 8 | 60 | 869 | 900 | 1 | 50 | 400 | 300 | 300 | 0.4 |
| 9 | 60 | 873 | 900 | 200 | 50 | 400 | 300 | 300 | 0.4 |
| 10 | 60 | 873 | 900 | 200 | 2 | 350 | 300 | 300 | 0.4 |
| 11 | 65 | 935 | 950 | 200 | 50 | 400 | 300 | 200 | 0.4 |
| 12 | 65 | 822 | 900 | 200 | 50 | 350 | 300 | 200 | 0.4 |
| 13 | 50 | 853 | 900 | 200 | 50 | 400 | 300 | 200 | 0.4 |
| 14 | 55 | 853 | 900 | 200 | 50 | 380 | 300 | 300 | 0.4 |
| 15 | 50 | 853 | 900 | 200 | 50 | 350 | 300 | 200 | 0.4 |
| 16 | 60 | 909 | 920 | 200 | 50 | 350 | 300 | 300 | 0.4 |
| 17 | 50 | 964 | 970 | 200 | 50 | 400 | 300 | 200 | 0.4 |
| 18 | 60 | 891 | 900 | 300 | 50 | 100 | — | — | 0.4 |
| 19 | 50 | 891 | 900 | 300 | 50 | 200 | — | — | 0.4 |
| 20 | 50 | 892 | 900 | 200 | 50 | 350 | 300 | 300 | 0.4 |
| 21 | 55 | 830 | 900 | 200 | 200 | 350 | 300 | 300 | 0.4 |
| 22 | 60 | 891 | 900 | 200 | 50 | 50 | — | — | 0.4 |
| 23 | 60 | 891 | 900 | 200 | 50 | 100 | — | — | 0.4 |

TABLE 2-2-continued

| Sample No. | Cold rolling Cold rolling reduction (%) | Annealing Ac3 (° C.) | Annealing temperature (° C.) | Annealing time (sec) | Colling rate (° C./s) | Cooling stop temperature (° C.) | Low temperature retention temperature (° C.) | Low temperature retention time (sec) | Temper rolling Skin pass rolling (%) |
|---|---|---|---|---|---|---|---|---|---|
| 24 | 60 | 891 | 900 | 200 | 50 | 100 | — | — | 0.4 |
| 25 | 50 | 896 | 900 | 200 | 50 | 350 | 300 | 300 | 0.4 |
| 26 | 55 | 845 | 900 | 200 | 50 | 300 | 270 | 300 | Absent |
| 27 | 50 | 845 | 900 | 200 | 50 | 100 | — | — | 0.4 |
| 28 | 50 | 889 | 900 | 200 | 50 | 350 | 300 | 300 | 0.4 |
| 29 | 50 | 889 | 900 | 200 | 50 | 350 | 300 | 300 | 0.4 |
| 30 | 50 | 889 | 900 | 200 | 50 | 350 | 300 | 300 | 0.4 |
| 31 | 50 | 1077 | 1090 | 200 | 50 | 350 | 300 | 300 | 0.4 |

The steel structure of the obtained cold-rolled steel sheet was observed, and the area ratio of a hard structure and the area ratio of austenite and area ratio of other structures (ferrite and pearlite) were obtained.

The area ratio of each structure was determined as follows.

A sample was collected from the steel sheet so that a sheet thickness cross section perpendicular to the rolling direction of the steel sheet was set as an observed section, the observed section was polished and subjected to nital etching, and the structure at a ¼ position of the thickness of the steel sheet was observed with a scanning electron microscope (SEM) at a magnification of 5,000-fold. Image analysis was performed on a visual field of 100 μm×100 μm to measure the area ratios of ferrite and pearlite. Five visual fields were measured at the center in a sheet width direction, and the average of these measurement values was obtained.

Thereafter, the area ratio of residual austenite was obtained.

The area ratio of the austenite was measured by an X-ray diffraction method as follows. A portion from the surface of the steel sheet to ¼ of the thickness of the steel sheet was removed by mechanical polishing and chemical polishing, and MoKα rays were used as characteristic X-rays. From the integrated intensity ratio of the diffraction peaks of (200) and (211) of a body-centered cubic lattice (bcc) phase and (200), (220), and (311) of a face-centered cubic lattice (fcc) phase, the volume percentage of the residual austenite was calculated using the following formula, and this was regarded as the area ratio. In the following formula, Sγ represents the area ratio of the residual austenite, $I_{200f}$, $I_{220f}$ and $I_{311f}$ respectively represent the diffraction peak intensities of (200), (220), and (311) of the fcc phase, and $I_{200b}$ and $I_{211b}$ respectively represent the diffraction peak intensities of (200) and (211) of the bcc phase.

$$S\gamma=(I_{200f}+I_{220f}+I_{311f}/(I_{200b}+I_{211b})\times 100$$

The area ratio of ferrite and pearlite obtained by the above method and the area ratio of residual austenite were subtracted from the whole to obtain the area ratio of the hard structure.

The results are shown in Table 3.

Furthermore, the tensile strength TS, fracture elongation EL, and bake-hardening amount BH of the obtained cold-rolled steel sheet were measured. In measurement of the tensile strength TS, fracture elongation EL, and bake-hardening amount BH, a JIS No. 5 tensile test piece having a direction perpendicular to the rolling direction as the longitudinal direction was collected and subjected to a tensile test in accordance with JIS Z 2241:2011.

BH was a value obtained by subtracting the stress when 0.5% pre-strain was added from the yield stress when a test piece subjected to a heat treatment at 170° C. for 20 minutes was re-tensioned after the 0.5% pre-strain was added. The steel sheet is a steel sheet having high bake-hardenability for BH at 0.5% pre-strain. By adopting BH at 0.5% pre-strain as an evaluation index, ductility after producing the steel sheet as a component formed article is ensured.

When the tensile strength was 900 MPa or more, it was determined that a preferable strength was obtained in order to satisfy the demand for a reduction in the weight of a vehicle body. The tensile strength is preferably 1000 MPa or more, and more preferably 1100 MPa or more.

Moreover, in a case of assuming that press forming or the like is performed, it is preferable that elongation is 10% or more.

Moreover, regarding BH, since it was difficult to perform forming at a BH of 150 MPa or less and the strength was reduced after the forming, it was determined that excellent bake-hardenability was achieved at a BH of 150 MPa or more. BH is more preferably 200 MPa or more, and most preferably 250 MPa or more.

The underline in Table 3 indicates that the numerical value is out of the desired range.

The degree of microsegregation of Mn represented by C1/C2 was measured as follows. The steel sheet was adjusted so that a cross section in the sheet thickness direction in which the rolling direction was the normal direction could be observed and then mirror-polished, and in the cross section of the steel sheet in the thickness direction, in a range of 100 μm in the sheet thickness direction included in a region between a ⅜ position and a ¼ position of the thickness of the steel sheet from the surface of the steel sheet, the Mn content was measured at 200 points with an interval of 0.5 μm from one surface side to the other surface side along the steel sheet thickness direction, by an electron probe microanalyzer (EPMA) apparatus. Here, the Mn content was measured, while avoiding inclusions such as MnS. The same measurement was performed on five lines covering almost the entire region in the width direction in the cross section of the steel sheet, and by employing the highest value among the Mn contents measured on all the five lines as the upper limit C1 (unit: mass %) of the Mn content and the lowest value as the lower limit C2 (mass %) of the Mn content, the ratio C1/C2 was calculated.

TABLE 3

| | Mechanical property value | | | Steel structure | | | | |
|---|---|---|---|---|---|---|---|---|
| Sample No. | TS (MPa) | El (%) | BH (MPa) | Hard Structure area ratio (%) | Residual austenite area ratio (%) | Area ratio of other structures (%) | Mn concentration ratio C1/C2 | Note |
| 1 | 1289 | 11 | 220 | 98 | 2 | 0 | 1.3 | Invention Example |
| 2 | 1331 | 9 | 143 | 98 | 2 | 0 | 1.2 | Comparative Example |
| 3 | 1221 | 10 | 292 | 97 | 3 | 0 | 1.1 | Invention Example |
| 4 | 1150 | 11 | 140 | 90 | 10 | 0 | 1.3 | Comparative Example |
| 5 | 1189 | 11 | 189 | 96 | 4 | 0 | 1.2 | Invention Example |
| 6 | 1175 | 10 | 201 | 98 | 2 | 0 | 1.2 | Invention Example |
| 7 | 655 | 10 | 49 | 10 | 0 | 90 | 1.4 | Comparative Example |
| 8 | 902 | 15 | 121 | 50 | 0 | 50 | 1.2 | Comparative Example |
| 9 | 1145 | 10 | 205 | 95 | 5 | 0 | 1.4 | Invention Example |
| 10 | 674 | 14 | 65 | 5 | 0 | 95 | 1.3 | Comparative Example |
| 11 | 848 | 34 | 40 | 10 | 0 | 90 | 1.2 | Comparative Example |
| 12 | 1231 | 10 | 123 | 98 | 2 | 0 | 1.4 | Comparative Example |
| 13 | 1147 | 11 | 187 | 97 | 3 | 0 | 1.3 | Invention Example |
| 14 | 1159 | 11 | 138 | 97 | 3 | 0 | 1.7 | Comparative Example |
| 15 | 1221 | 11 | 122 | 97 | 3 | 0 | 1.8 | Comparative Example |
| 16 | 1324 | 9 | 189 | 98 | 2 | 0 | 1.4 | Invention Example |
| 17 | 789 | 20 | 55 | 9 | 0 | 91 | 1.3 | Comparative Example |
| 18 | 1199 | 10 | 203 | 96 | 4 | 0 | 1.2 | Invention Example |
| 19 | 1187 | 10 | 137 | 97 | 3 | 0 | 1.6 | Comparative Example |
| 20 | 1248 | 10 | 198 | 97 | 3 | 0 | 1.3 | Invention Example |
| 21 | 1318 | 11 | 301 | 100 | 0 | 0 | 1.2 | Invention Example |
| 22 | 1189 | 11 | 202 | 97 | 3 | 0 | 1.4 | Invention Example |
| 23 | 1172 | 12 | 113 | 97 | 3 | 0 | 1.8 | Comparative Example |
| 24 | 1207 | 10 | 141 | 96 | 4 | 0 | 2.1 | Comparative Example |
| 25 | 1254 | 10 | 250 | 99 | 1 | 0 | 1.3 | Invention Example |
| 26 | 1454 | 10 | 142 | 98 | 2 | 0 | 2.0 | Comparative Example |
| 27 | 1410 | 10 | 302 | 99 | 1 | 0 | 1.3 | Invention Example |
| 28 | 1211 | 10 | 242 | 98 | 2 | 0 | 1.4 | Invention Example |
| 29 | 1199 | 12 | 143 | 98 | 2 | 0 | 1.8 | Comparative Example |
| 30 | 1175 | 12 | 139 | 99 | 1 | 0 | 1.9 | Comparative Example |
| 31 | 1110 | 13 | 181 | 99 | 1 | 0 | 1.4 | Invention Example |

[Evaluation Results]

As shown in Table 3, in Sample Nos. 1, 3, 5, 6, 9, 13, 16, 18, 20-22, 25, 27, 28, and 31 within the range of the present invention, excellent tensile strength and BH could be obtained. In any of the cases, the tensile strength was 900 MPa or more and BH was 150 MPa or more, indicating that the strength was high and the bake-hardenability was excellent. In the examples of the present invention, phases and structures other than martensite and austenite were not observed.

On the other hand, in Sample No. 2, since the final skin pass step was not performed, the dislocation density in the structure was low and BH was low.

In Sample No. 4, since the amount of residual austenite was too large, the bake-hardening of martensite was not sufficiently exhibited, and BH was low.

In Sample No. 7, since the annealing temperature was too low, a large amount of ferrite was generated and BH was low. In addition, TS was also low.

In Sample No. 8, since the annealing time was too short, a large amount of ferrite was generated and BH was low.

In Sample No. 10, since the cooling rate after annealing was too slow, a hard structure was not sufficiently obtained, and BH was low. In addition, TS was also low.

In Sample No. 11, the C content was low and BH was low.

In Sample No. 12, the Si content was low and BH was low.

In Sample No. 14, since the temperature range of the multiaxial deformation processing was low, microsegregation of Mn had occurred and BH was low.

In Sample No. 15, the coiling temperature was low. As a result, Mn did not diffuse sufficiently, microsegregation had occurred, and BH was low.

In Sample No. 17, BH was low because the Mn content was too small. In addition, TS was also low.

In Sample No. 19, the deformation ratio of the multiaxial deformation processing was low. As a result, microsegregation of Mn had occurred and BH was low.

In Sample No. 23, the total rolling reduction of finish rolling was high. As a result, austenite was stretched, microsegregation of Mn had occurred, and BH was low.

In Sample No. 24, the slab was rolled without performing the multiaxial deformation processing. As a result, microsegregation of Mn had occurred and BH was low.

In Sample No. 26, a multiaxial deformation processing step and a final skin pass step were not performed. As a result, microsegregation of Mn had occurred, the dislocation density was low, and BH was low.

In Sample No. 29, the hot rolling finishing temperature was low. As a result, microsegregation of Mn had occurred in an unrecrystallized austenite portion, and BH was low.

In Sample No. 30, the coiling temperature was high. As a result, pearlite was generated, microsegregation of Mn had occurred, and BH was low.

INDUSTRIAL APPLICABILITY

The steel sheet of the present invention can be used as an original sheet for structural materials of vehicles, particularly in a vehicle industrial field.

What is claimed is:

1. A steel sheet comprising, as a chemical composition, by mass %:
C: 0.05% to 0.30%;
Si: 0.2% to 2.0%;
Mn: 2.0% to 4.0%;
Al: 0.001% to 2.000%;
P: 0.100% or less;
S: 0.010% or less;
N: 0.010% or less;
Ti: 0% to 0.100%;
Nb: 0% to 0.100%;
V: 0% to 0.100%;
Cu: 0% to 1.00%;
Ni: 0% to 1.00%;
Mo: 0% to 1.00%;
Cr: 0% to 1.00%;
W: 0% to 0.005%;
Ca: 0% to 0.005%;
Mg: 0% to 0.005%;
a rare earth element (REM): 0% to 0.010%;
B: 0% to 0.0030%; and
a remainder of Fe and impurities,
wherein a metallographic structure contains, by area ratio, 95% or more of martensite and 0% to 5% of residual austenite,
in a cross section in a thickness direction, by mass %, C1/C2 which is a ratio of an upper limit C1 of a Mn content to a lower limit C2 of the Mn content is 1.5 or less, and
a bake-hardening amount BH is 150 MPa or more.

2. The steel sheet according to claim 1,
wherein the chemical composition includes, by mass %, one or two or more of:
Ti: 0.003% to 0.100%;
Nb: 0.003% to 0.100%; and
V: 0.003% to 0.100%, and
a total amount of Ti, Nb, and V is 0.100% or less.

3. The steel sheet according to claim 2,
wherein the chemical composition includes, by mass %, one or two or more of:
Cu: 0.005% to 1.00%;
Ni: 0.005% to 1.00%;
Mo: 0.005% to 1.00%; and
Cr: 0.005% to 1.00%, and
a total amount of Cu, Ni, Mo, and Cr is 1.00% or less.

4. The steel sheet according to claim 3,
wherein the chemical composition includes, by mass %, one or two or more of:
W: 0.0003% to 0.005%;
Ca: 0.0003% to 0.005%;
Mg: 0.0003% to 0.005%; and
a rare earth element (REM): 0.0003% to 0.010%, and
a total amount of W, Ca, Mg, and the rare earth element (REM) is 0.010% or less.

5. The steel sheet according to claim 4,
wherein the chemical composition includes, by mass %:
B: 0.0001% to 0.0030%.

6. The steel sheet according to claim 3,
wherein the chemical composition includes, by mass %:
B: 0.0001% to 0.0030%.

7. The steel sheet according to claim 2,
wherein the chemical composition includes, by mass %, one or two or more of:
W: 0.0003% to 0.005%;
Ca: 0.0003% to 0.005%;
Mg: 0.0003% to 0.005%; and
a rare earth element (REM): 0.0003% to 0.010%, and
a total amount of W, Ca, Mg, and the rare earth element (REM) is 0.010% or less.

8. The steel sheet according to claim 7,
wherein the chemical composition includes, by mass %:
B: 0.0001% to 0.0030%.

9. The steel sheet according to claim 2,
wherein the chemical composition includes, by mass %:
B: 0.0001% to 0.0030%.

10. The steel sheet according to claim 1,
wherein the chemical composition includes, by mass %, one or two or more of:
Cu: 0.005% to 1.00%;
Ni: 0.005% to 1.00%;
Mo: 0.005% to 1.00%; and
Cr: 0.005% to 1.00%, and
a total amount of Cu, Ni, Mo, and Cr is 1.00% or less.

11. The steel sheet according to claim 10,
wherein the chemical composition includes, by mass %, one or two or more of:
W: 0.0003% to 0.005%;
Ca: 0.0003% to 0.005%;
Mg: 0.0003% to 0.005%; and
a rare earth element (REM): 0.0003% to 0.010%, and
a total amount of W, Ca, Mg, and the rare earth element (REM) is 0.010% or less.

12. The steel sheet according to claim 11,
wherein the chemical composition includes, by mass %:
B: 0.0001% to 0.0030%.

13. The steel sheet according to claim 10,
wherein the chemical composition includes, by mass %:
B: 0.0001% to 0.0030%.

14. The steel sheet according to claim 1,
wherein the chemical composition includes, by mass %, one or two or more of:
W: 0.0003% to 0.005%;
Ca: 0.0003% to 0.005%;
Mg: 0.0003% to 0.005%; and
a rare earth element (REM): 0.0003% to 0.010%, and a total amount of W, Ca, Mg, and the rare earth element (REM) is 0.010% or less.

15. The steel sheet according to claim 14, wherein the chemical composition includes, by mass %: B: 0.0001% to 0.0030%.

16. The steel sheet according to claim 1, wherein the chemical composition includes, by mass %: B: 0.0001% to 0.0030%.

* * * * *